US009997862B2

(12) United States Patent
Zhou et al.

(10) Patent No.: US 9,997,862 B2
(45) Date of Patent: Jun. 12, 2018

(54) ELECTRICAL CONNECTOR HAVING METALLIC BRACKET EMBEDDED WITHIN INSULATIVE MATING SHELL

(71) Applicant: FOXCONN INTERCONNECT TECHNOLOGY LIMITED, Grand Cayman (KY)

(72) Inventors: Shao-Cong Zhou, Huaian (CN); Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days. days.

(21) Appl. No.: 15/813,027

(22) Filed: Nov. 14, 2017

(65) Prior Publication Data

US 2018/0138627 A1 May 17, 2018

(30) Foreign Application Priority Data

Nov. 14, 2016 (CN) ..... 2016 1 0998266

(51) Int. Cl.

| | |
|---|---|
| ***H01R 13/648*** | (2006.01) |
| ***H01R 13/504*** | (2006.01) |
| ***H01R 13/627*** | (2006.01) |
| ***H01R 43/20*** | (2006.01) |
| ***H01R 13/52*** | (2006.01) |
| ***H01R 13/405*** | (2006.01) |

(52) U.S. Cl.

CPC ..... *H01R 13/504* (2013.01); *H01R 13/405* (2013.01); *H01R 13/5202* (2013.01); *H01R 13/6273* (2013.01); *H01R 43/20* (2013.01)

(58) Field of Classification Search

CPC ..... H01R 13/6587; H01R 13/6534; H01R 23/6873; H01R 23/7073

USPC ..... 439/607.4, 607.35, 607.36, 660

See application file for complete search history.

(56) References Cited

U.S. PATENT DOCUMENTS

| | | | | |
|---|---|---|---|---|
| 8,672,711 | B2 * | 3/2014 | Kondo | H01R 12/57 439/607.1 |
| 8,827,742 | B2 * | 9/2014 | Wang | H01R 24/68 439/569 |
| 9,028,269 | B2 * | 5/2015 | Hsu | H01R 13/6582 439/357 |
| 2017/0324187 | A1 | 11/2017 | Zhu et al. | |

FOREIGN PATENT DOCUMENTS

| | | | |
|---|---|---|---|
| CN | 203521730 | U | 4/2014 |
| CN | 204216260 | U | 3/2015 |
| CN | 105826742 | A | 8/2016 |
| TW | M447009 | U1 | 2/2013 |
| TW | M509995 | U | 10/2015 |

* cited by examiner

*Primary Examiner* — Phuong Dinh

(74) *Attorney, Agent, or Firm* — Wei Te Chung; Ming Chieh Chang

(57) ABSTRACT

An electrical connector includes a contact module and a mating/outer case enclosing the contact module. The mating case includes an insulative shell with a metallic reinforcement bracket embedded therein. The insulative shell forms opposite inner and outer surfaces wherein the inner surface forms a mating cavity for receiving a complementary plug connector therein, and the bracket is essentially located between the outer surface and the inner surface except the corresponding mounting legs extending out of the insulative shell for mounting to a printed circuit board.

14 Claims, 10 Drawing Sheets

ELECTRICAL CONNECTOR HAVING METALLIC BRACKET EMBEDDED WITHIN INSULATIVE MATING SHELL

BACKGROUND OF THE DISCLOSURE

1. Field of the Disclosure

The invention is related to an electrical connector and the method of making the same, and particularly to the electrical connector having a mating cavity formed by the insulative shell with a metallic bracket embedded therein.

2. Description of Related Arts

Taiwan Utility Patent No. M509995 discloses the electrical connector having an inner metallic shell, which forms the mating cavity for mating with t complementary plug connector, and an outer metallic shell/bracket, which is equipped with the mounting legs for mounting to the printed circuit board, attached thereon, and an outer insulative case enclosing both the metallic inner shell and outer shell for waterproofing consideration. Anyhow, the inner shell and the outer shell are required to be soldered together before commonly integrally formed within the insulative outer case, thus taking more labor and costing more money. In addition, the metallic inner shell directly facing the mating cavity, may result in some improper interference during signal transmission.

It is desired to provide an electrical connector with the unified metallic shell cooperating with an insulative case which not only encloses an exterior of the whole connector for waterproofing but also directly and intimately forms the corresponding mating cavity for plug mating, thus simplifying manufacturing and structures of the whole connector and preventing any improper interference.

SUMMARY OF THE DISCLOSURE

To achieve the above desire, an electrical connector includes a contact module and a mating/outer case enclosing the contact module. The mating case includes an insulative shell with a metallic reinforcement bracket embedded therein. The insulative shell forms opposite inner and outer surfaces wherein the inner surface forms a mating cavity for receiving a complementary plug connector therein, and the bracket is essentially located between the outer surface and the inner surface except the corresponding mounting legs extending out of the insulative shell for mounting to a printed circuit board. Correspondingly, the method of making the above-mentioned electrical connector includes the following steps. First, the metallic reinforcement bracket is insert-molded within the insulative shell to commonly form the mating case wherein an interior surface of the insulative shell forms the mating cavity for receiving a complementary plug connector and the bracket forms mounting legs extending out of the insulative shell for mounting to a printed circuit board. Secondly, a contact module is forwardly assembled into the mating case wherein a mating tongue of the contact module is located in the mating cavity for mating with the complementary plug connector.

DETAILED DESCRIPTION OF THE PREFERRED EMBODIMENT

Figure 1:
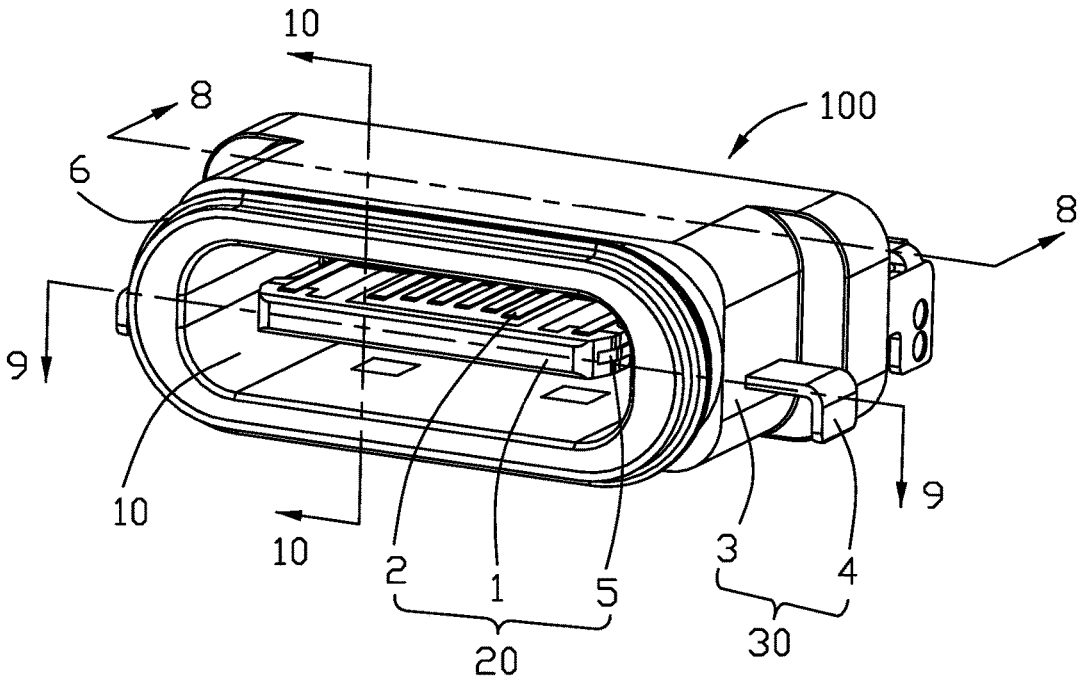
FIG. 1 is a front perspective view of an electrical connector with according to the invention.
Figure 2:
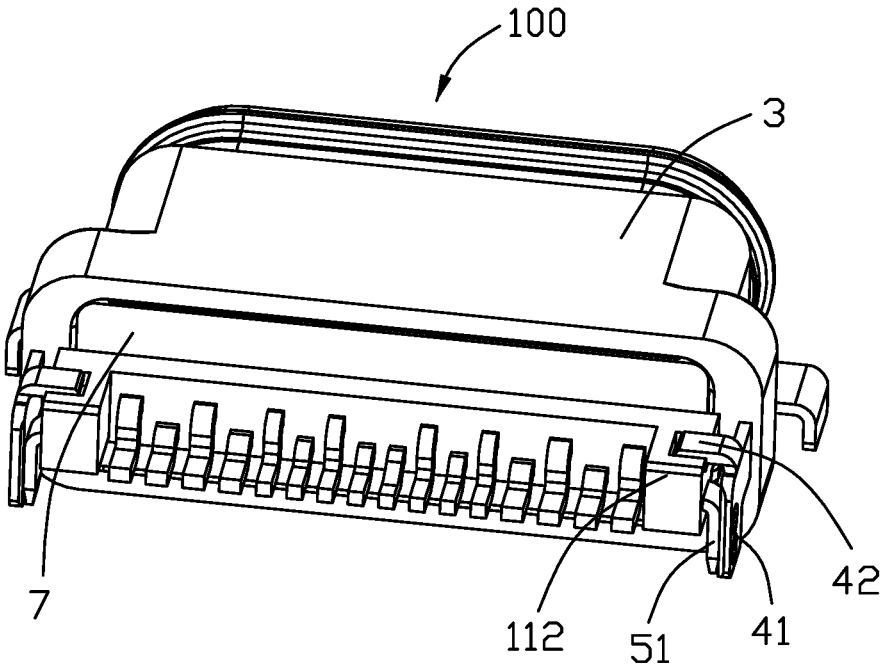
FIG. 2 is a rear perspective view of the electrical connector of FIG. 1.

Reference will now be made in detail to the embodiments of the present disclosure. Referring to FIGS. 1-10, an electrical card connector 100 adapted for mounting to a printed circuit board (not shown), forms a mating cavity 10 for directly and intimately receiving a complementary Type C plug connector (not shown) therein.

The connector 100 includes a contact module 20 and a mating case 30 enclosing the contact module 20, a waterproof gasket 6 surrounding a front end region of the mating case 30, and a waterproof plate 7 attached to a rear face of the contact module 20 within the mating case 30. The contact module 20 includes an insulative body 1, a plurality of contacts 2 and a pair of metallic latching pieces 5 commonly integrally formed within the insulative body 1 via insert-molding. The mating case 30 includes an insulative shell 3 and a metallic reinforcement bracket 4 integrally formed together via insert-molding. The waterproof gasket 6 may be assembled upon or integrally formed upon an exterior surface of the insulative shell 3.

Referring to FIGS. 3-5 and 8, the insulative shell 3 forms an interior surface 31 and an exterior surface 32. The mating cavity 10 is formed by the interior surface 31. The interior surface 31 includes opposite first interior surface 311 and second interior surface 312, and opposite third interior surface 313 and fourth interior surface 314, thus precisely assuring the configuration and dimensions of the mating cavity. The metallic reinforcement bracket 4 is essentially embedded within the insulative shell 3 for enhancing the whole structures thereof. The reinforcement bracket 4 includes a plurality of embossments 401 which are used not only for supporting during insert-molding the reinforcement bracket 4 within the insulative shell 3 but also for mechanically and electrically connecting the shell of the plug connector (not shown) for grounding. The reinforcement bracket 4 includes (rear) mounting legs 41 and the front mounting legs (unlabeled) for mounting to the printed circuit board (not shown), and the securing tabs 42. A rear opening 33 is formed in a rear side of the insulative shell 3, through which the contact module 20 can be forwardly inserted into the mating case 30. Notably, an assembling cavity 50 is formed in front of the rear opening 33 and in communication with the mating cavity 10 wherein the assembling cavity 50 is larger than the mating cavity 10 with a stopping face 331 thereon.

Figure 3:
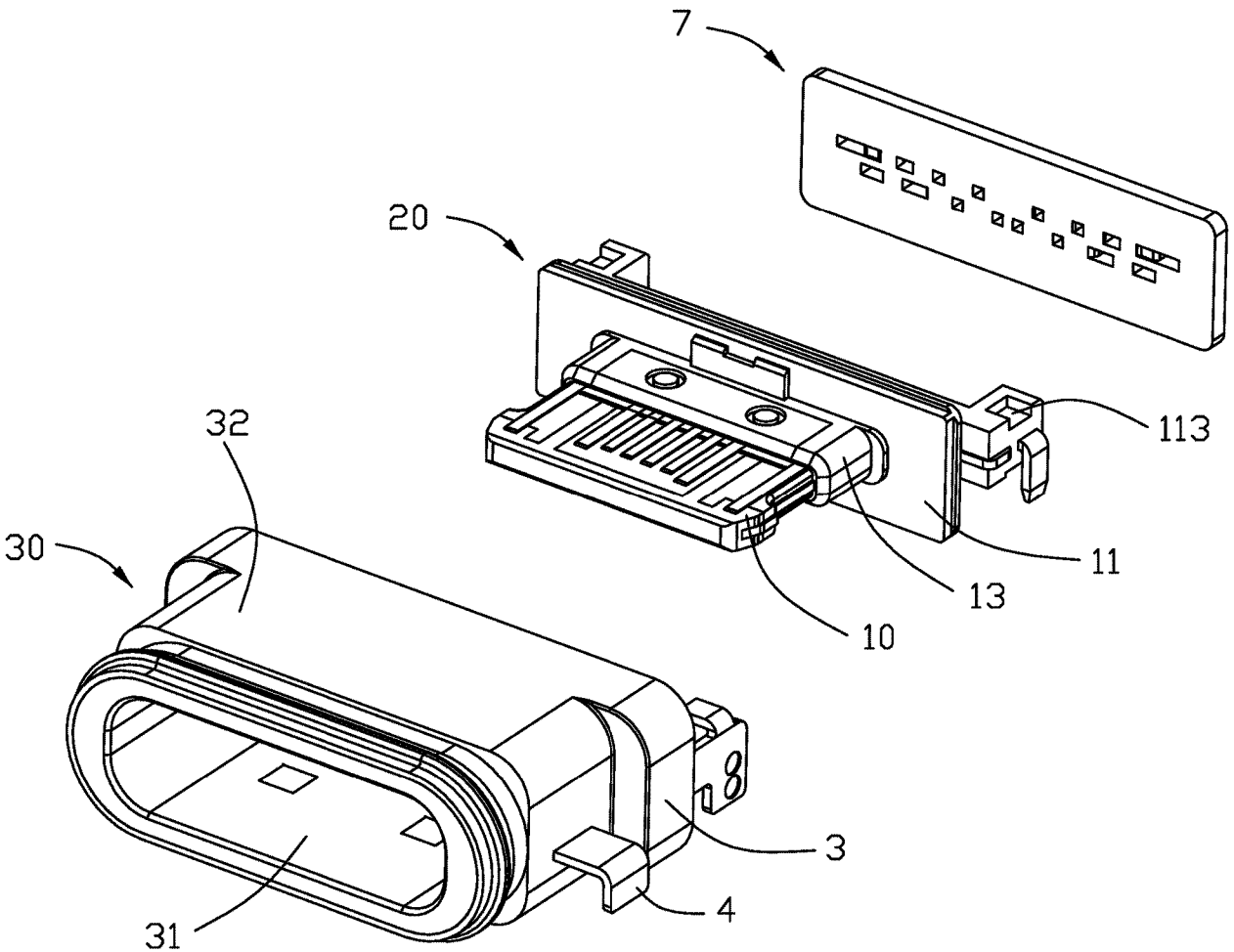
FIG. 3 is a front exploded perspective view of the electrical connector of FIG. 1.
Figure 4:
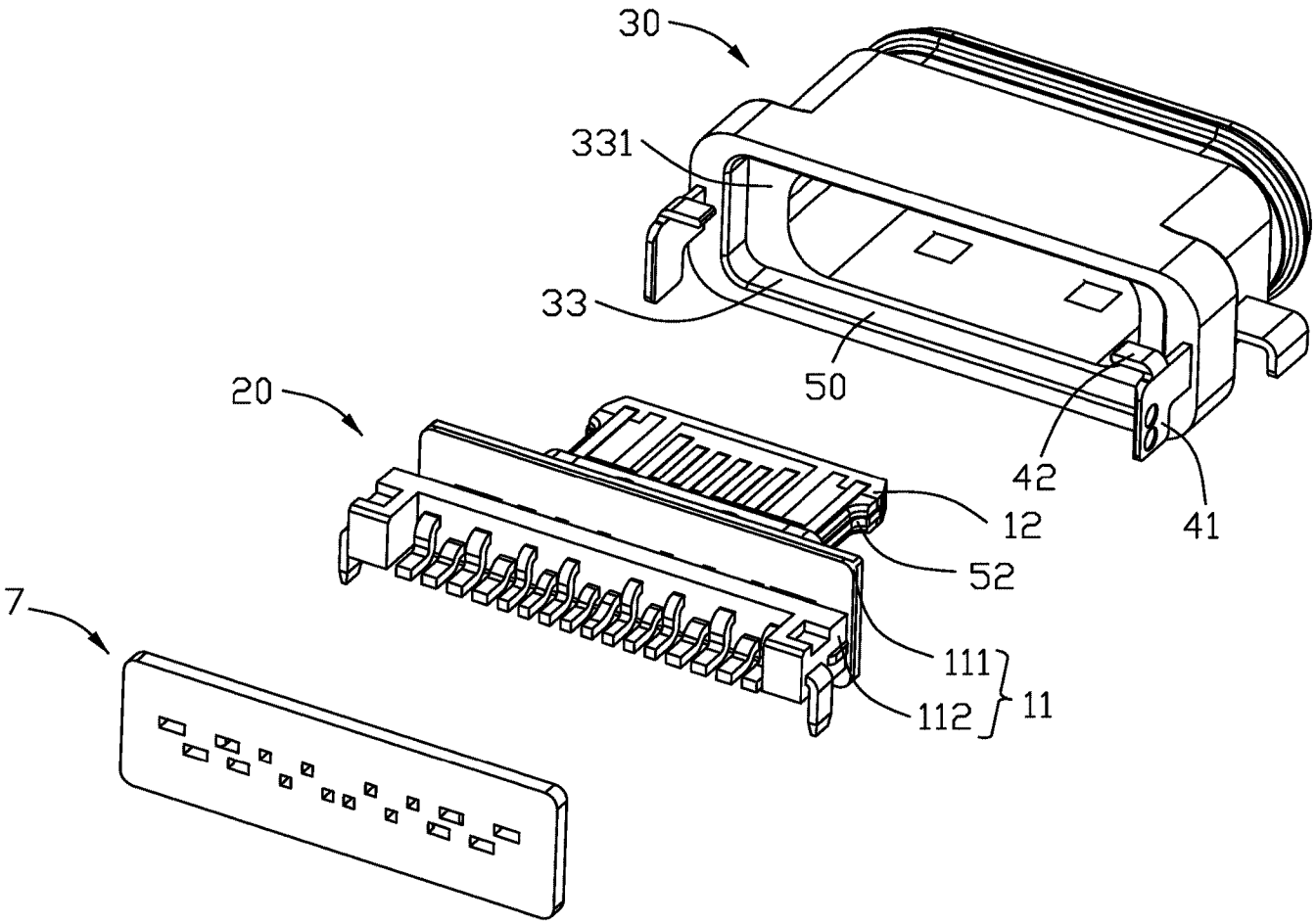
FIG. 4 is a rear perspective view of the electrical connector of FIG. 1.
Figure 5:
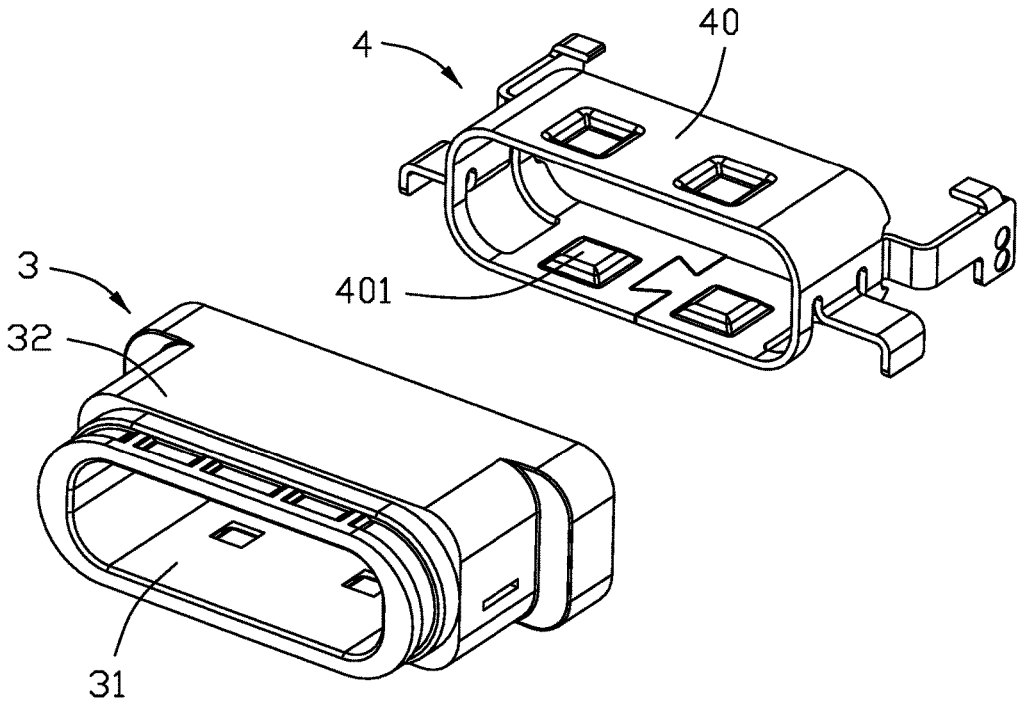
FIG. 5 is an exploded perspective view of the mating case of the electrical connector of FIG. 1.

Referring to FIGS. 3 and 4, the insulative body 1 includes a base 11 and a mating tongue 12 extending forwardly from the base 11, a step portion 13 formed around the root region of the mating tongue 12. The latching pieces 5 are located on two sides of the mating tongue 12 and include corresponding securing legs 51. The base 11 includes a first base 111 abutting against the stopping face 331 and a second base 112 spaced from the first base 111 in the front-to-back direction. The latching piece 5 includes a connection section 55, a locking arm 54 extending forwardly from the connection section 55, and a locking head 53 located at a front end of the locking arm 54 forming a locking edge 52 thereof. The connection section 55 includes a first connection region 552 embedded within the first base 111, a second connection region 553 embedded within the second base 112, and a third connection region 551 between the first connection region 552 and the second connection region 553 and embedded within the waterproof plate 7 which is located between the first base 111 and the second base 112. The base 11 forms cutouts 113 to receive the corresponding securing tabs 42 therein, respectively, so as to assure the correct position of the contact module 20 with regard to the mating case 30. The securing leg 51 abuts against and is soldered with the corresponding mounting leg 41 for not only securing the contact module 20 and the mating case 30 together but also commonly mounting to the same mounting hole of the printed circuit board (not shown). Notably, the notch formed in the printed circuit board may be rectangular or of a tenon configuration for compliance with a cross-section of the whole connector 100 when the connector 100 is downwardly mounted upon the printed circuit board and partially sunk within the notch.

Figure 6:
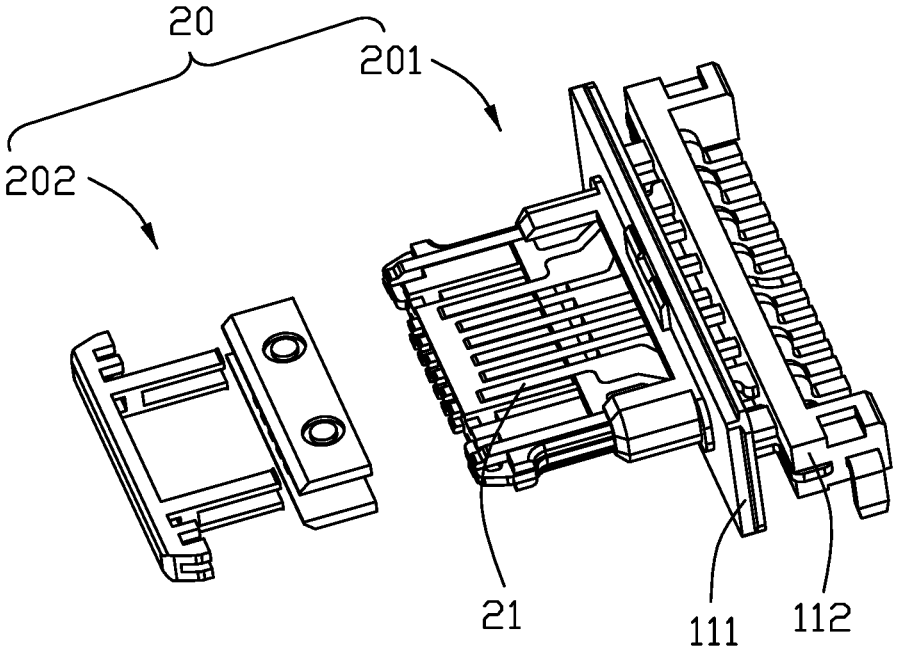
FIG. 6 is an exploded perspective view of the contact module of the electrical connector of FIG. 1.
Figure 7:
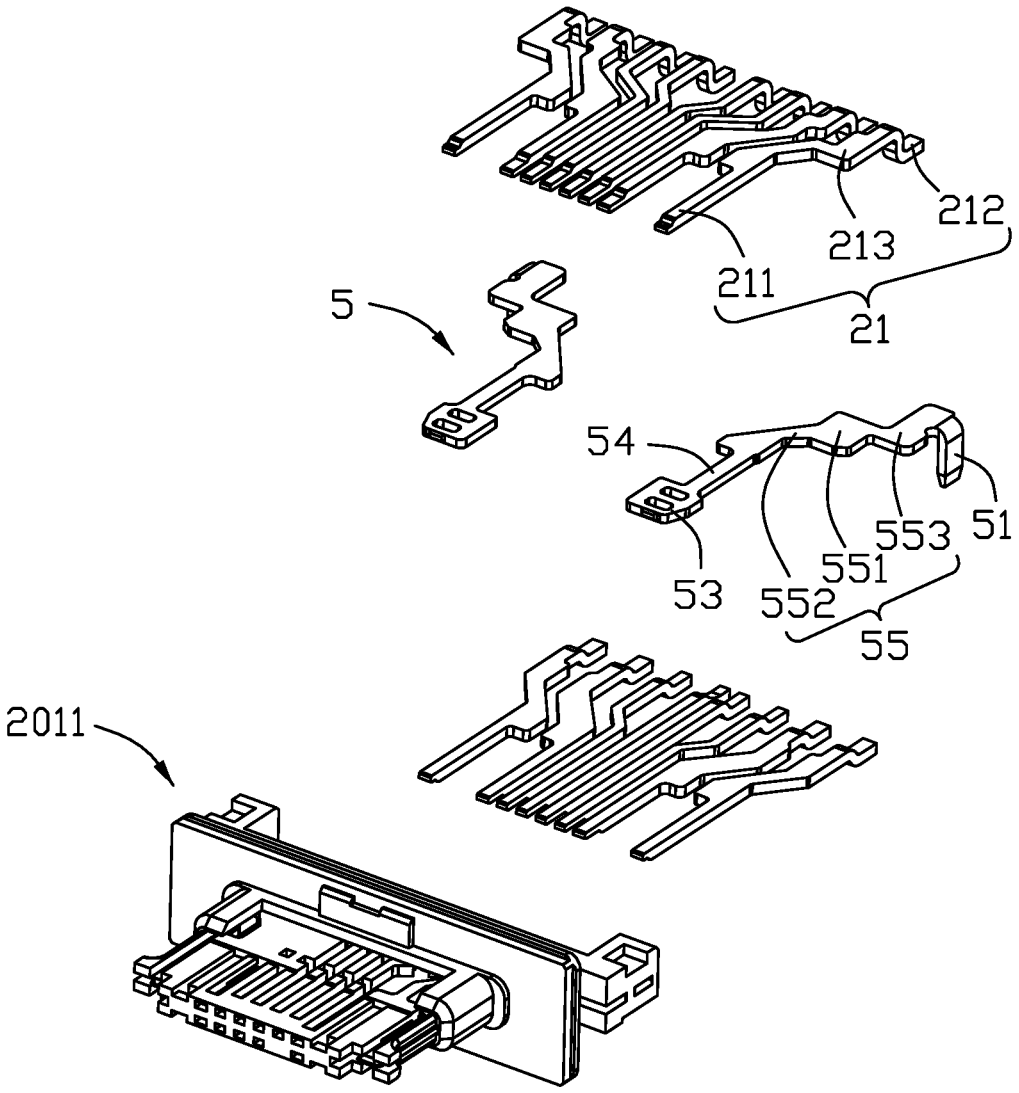
FIG. 7 is a further exploded perspective view of the contact module of the electrical connector of FIG. 6.
Figure 8:
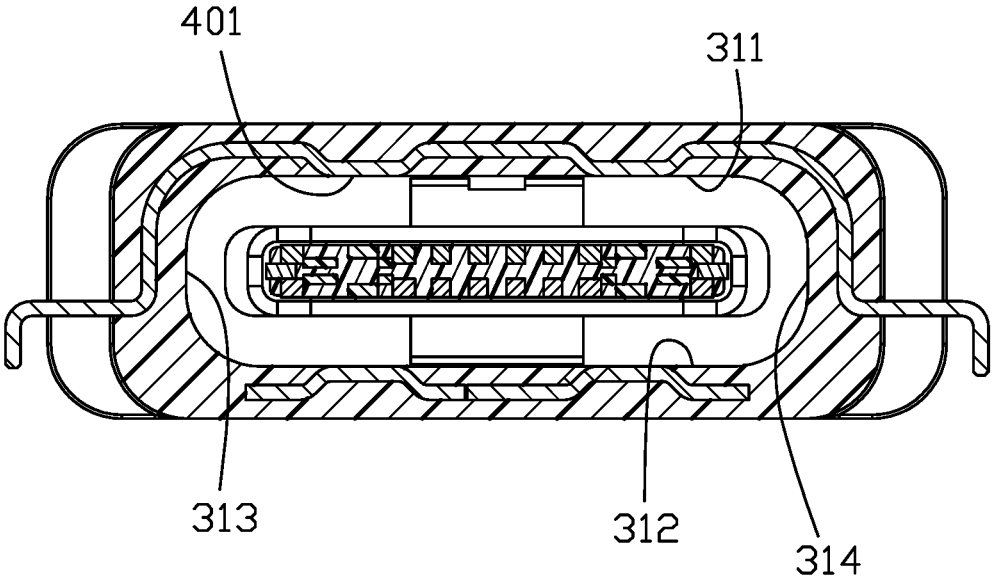
FIG. 8 is a cross-sectional view of the electrical connector of FIG. 1 along line 8-8.

Referring to FIGS. 6 and 7, the contact module 20 includes an initial basic module 201, and an additional insulator 202 successively applied upon the basic module 201 for forming the complete mating tongue 12 and the step portion 13. The basic module 201 including a basic insulator 2011 integrally formed with the first/upper contacts, the second/lower contacts and the latching pieces 5 therebetween via insert-molding. The contacts 2 includes contacts 21 each having a front contacting section 211, a rear soldering section 212 and therebetween a securing section 213 secured to/embedded within the first base 111 and the second base 112 and the waterproof plate 7 therebetween.

Figure 9:
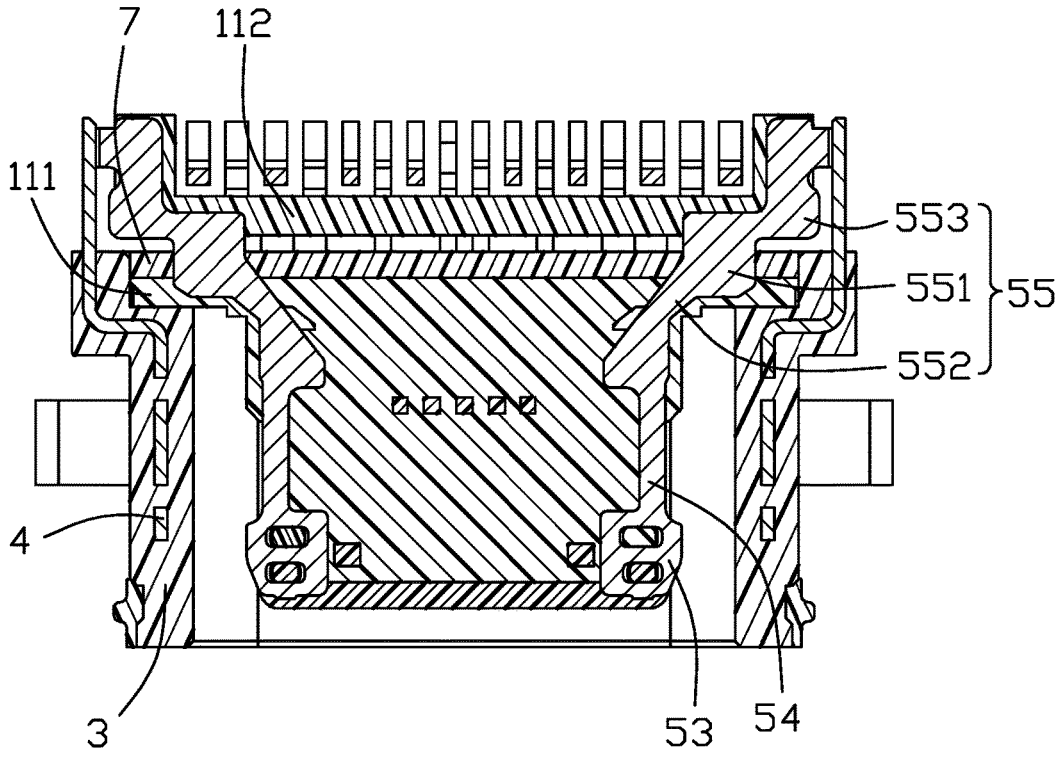
FIG. 9 is a cross-sectional view of the electrical connector of FIG. 1 along line 9-9.
Figure 10:
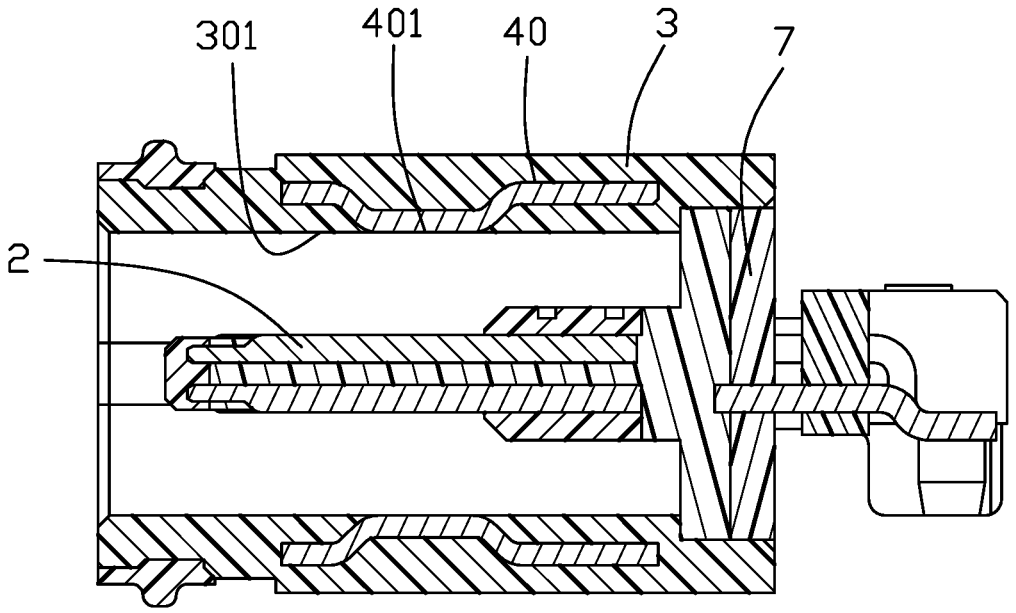
FIG. 10 is a cross-sectional view of the electrical connector of FIG. 1 along line 10-10.

Referring to FIGS. 9 and 10, the waterproof plate 7 is flush with a rear edge of the insulative shell 3 wherein the front face of the waterproof plate 7 is attached upon the first base 111 while the rear face of the waterproof plate 7 is spaced from the second base 112 to expose partial portions of the corresponding securing section 213 of the contact 2 and the third connection region 551 of the latching piece 5. Notably, the gap between the waterproof plate 7 and the second base 112 in the front-to-back direction also allows injection of the liquid type waterproof plate 7 to form the solidified one. Notably, the first base 111 is supportably retained by the contacts 2 and the latching pieces 5, the second base 112 is retained by the securing tabs 42, and the securing legs 51 are soldered with the mounting legs 41 the latching pieces 5, so that the first base 111 is immovable.

The method of making the electrical connector 100 includes the following steps: (I) applying the insulative shell 3 upon the metallic reinforcement bracket 4 via an insert-molding process to commonly form the mating/outer case 30 wherein the metallic reinforcement bracket is essentially located between opposite interior surface and outer surface of the insulative shell 3 and the interior surface of the insulative shell 3 forms the mating cavity 10 for receiving the complementary plug connector (not shown); (II) applying the insulative body 1 upon both the contacts 2 and the latching pieces 5 to form the contact module 20 with a forwardly extending mating tongue 12; (III) forwardly inserting the contact module 20 into the mating case 30 with the mating tongue 12 disposed in the mating cavity 10; and (IV) applying the waterproof plate 7 upon a rear side of the mating case 30. Notably, the contact module 20 is formed by applying the additional insulator 202 upon the basic module 201. The securing legs 51 are respectively soldered to the mounting legs 41.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

a mating case having an insulative shell and a metallic reinforcement bracket integrally formed with each other via an insert-molding process, said insulative shell defining opposite interior and exterior surfaces, said interior surface directly defining a mating cavity for directly and intimately receiving a complementary plug connector, said metallic reinforcement bracket embedded within the insulative shell and between said opposite interior and exterior surfaces except mounting legs extending out of the insulative shell for mounting to a printed circuit board; and a contact module assembled in the mating case and including a mating tongue extending into the mating cavity; wherein the metallic reinforcement bracket is fixed to the contact module; wherein the contact module includes an insulative body integrally formed with a plurality of contacts and a pair of latching pieces, and said metallic reinforcement bracket is fixed at least either to the insulative body by having a securing tab retained in a cutout of the insulative body, or to the latching pieces.

2. The electrical connector as claimed in claim 1, wherein the metallic reinforcement bracket defines a mounting leg soldered with a securing leg of the corresponding latching piece.

3. The electrical connector as claimed in claim 1, wherein said insulative body includes a first base abutting against the insulative shell, and a second base rearwardly spaced from the first base.

4. The electrical connector as claimed in claim 3, wherein said first base is enclosed within the insulative shell while said second base is exposed outside of a rear edge of the insulative shell.

5. The electrical connector as claimed in claim 1, wherein said contact module includes an insulative body integrally formed with a plurality of contacts and a pair of latching pieces, and the mating case forms a stopping face against which the insulative body forwardly abuts.

6. The electrical connector as claimed in claim 1, wherein a waterproof plate is applied upon a rear side of the insulative shell and flush with a rear edge of the insulative shell.

7. The electrical connector as claimed in claim 1, wherein said metallic reinforcement bracket includes a plurality of embossments exposed toward the mating cavity.

8. A method of making an electrical connector, comprising steps of:

applying an insulative shell upon a metallic reinforcement bracket via an insert-molding process wherein said insulative shell defines opposite interior and exterior surfaces, the interior surface directly defining a mating cavity for directly and intimately receiving a complementary plug connector, the metallic reinforcement bracket being embedded within the insulative shell and between the interior surface and the exterior surface except mounting legs extending out of the insulative shell for mounting to a printed circuit board;

forwardly inserting a contact module into the insulative shell; and securing the contact module to the metallic reinforcement bracket; wherein the step of securing the contact module to the metallic reinforcement bracket includes soldering a mounting leg of the metallic reinforcement bracket to a securing leg of a latching piece of the contact module, or bending a securing tab into a cutout of an insulative body of the contact module.

9. The method as claimed in claim 8, wherein the insulative shell forms a stopping face against which the contact module abuts forwardly.

10. The method as claimed in claim 9, wherein the contact module includes a first base abuts against the stopping face, and a second base rearwardly spaced from the first base.

11. The method as claimed in claim 10, wherein a waterproof plate located between the first base and the second base, is secured to the first base while space from the second base.

12. An electrical connector comprising:

a mating case having an insulative shell and a metallic reinforcement bracket integrally formed with each other via an insert-molding process, said insulative shell defining opposite interior surface and exterior surface, said interior surface directly defining and surrounding a mating cavity for intimately receiving a complementary plug connector, said metallic reinforcement bracket forming no portions extending along a front-to-back direction on the interior surface for surrounding the mating cavity; and a contact module assembled in the mating case and including a mating tongue extending into the mating cavity along the front-to-back direction; wherein the contact module includes an insulative body integrally formed with a plurality of contacts and a pair of latching pieces on two opposite lateral sides, and the mating case forms a stopping face against which the insulative body forwardly abuts; wherein the metallic reinforcement bracket is fixed to the contact module; wherein said metallic reinforcement bracket is fixed at least either to the insulative body by having a securing tab retained in a cutout of the insulative body, or to the latching pieces.

13. The electrical connector as claimed in claim 12, wherein said stopping face is formed by the insulative shell.

14. The electrical connector as claimed in claim 12, wherein said metallic reinforcement bracket further includes mounting legs extending out of the insulative shell for mounting to a printed circuit board.

* * * * *